US008827728B1

(12) United States Patent
Lin

(10) Patent No.: US 8,827,728 B1
(45) Date of Patent: Sep. 9, 2014

(54) BULB SOCKET HAVING TERMINALS CONNECTED TO A PARTIALLY STRIPPED CORD

(71) Applicant: De-Hui Lin, Zhubei (TW)

(72) Inventor: De-Hui Lin, Zhubei (TW)

( * ) Notice: Subject to any disclaimer, the term of this patent is extended or adjusted under 35 U.S.C. 154(b) by 24 days.

(21) Appl. No.: 13/798,091

(22) Filed: Mar. 13, 2013

(51) Int. Cl.
*H01R 29/00* (2006.01)
*H01R 13/717* (2006.01)

(52) U.S. Cl.
CPC ..... *H01R 13/7175* (2013.01)
USPC ..... 439/168

(58) Field of Classification Search
CPC . H01R 33/0836; H01R 33/0845; F21K 5/023
See application file for complete search history.

(56) References Cited

U.S. PATENT DOCUMENTS 4,418,973 A * 12/1983 Smetana et al. ..... 439/168
5,989,068 A * 11/1999 Shu ..... 439/619
6,123,433 A * 9/2000 Chen ..... 362/654
6,514,105 B2 * 2/2003 Lin ..... 439/699.2
6,609,814 B2 * 8/2003 Ahroni ..... 362/249.12
7,306,360 B2 * 12/2007 Lin ..... 362/653
7,568,951 B1 * 8/2009 Tseng ..... 439/619
7,665,863 B2 * 2/2010 Tseng ..... 362/249.02
2009/0075508 A1 * 3/2009 Mitter et al. ..... 439/168
2011/0318954 A1 * 12/2011 Lin ..... 439/366

* cited by examiner

*Primary Examiner* — Chandrika Prasad
(74) *Attorney, Agent, or Firm* — Leong C. Lei

(57) ABSTRACT

A connection seat of bulb socket of decorative lamp string includes a main body having upper and bottom portions. The top portion includes a partition board on which an LED is seated with two terminals on opposite sides of the partition board. The bottom portion has a partition board and two stop boards having inside inclination surfaces. The terminals of the LED are arranged to extend into the bottom portion and positioned against the partition board of the bottom portion. A power cord has two conductors respectively received between the partition board and the stop boards and in engagement with the two terminals of the LED. A bottom cap is mounted to the bottom portion in such a way that two raised bars of the cap push the core conductors to securely fix the core conductors and the terminals of the LED between the partition board and the stop boards.

4 Claims, 2 Drawing Sheets

BULB SOCKET HAVING TERMINALS CONNECTED TO A PARTIALLY STRIPPED CORD

(a) TECHNICAL FIELD OF THE INVENTION

The present invention generally relates to an improvement on the connection structure between an illuminant and a power cord.

(b) DESCRIPTION OF THE PRIOR ART

It is known that a lot of lamp strings of the same kind are available in the market. Most of these lamp strings use light-emitting diodes (LEDs) as illuminants. The connection between an LED and a power cord is generally done with piercing engagement, in which pins having knife-like sharp lower ends are fixed in a socket and is set in electrical connection with two terminals of the LED. The power cord is laid flat on a top of a bottom cap, whereby when the bottom cap is mounted to the socket, the knife-like lower ends of the pins located in the socket pierce through the power cord to contact conductive cores of the power cord thereby establishing electrical connection therebetween. However, electrical connection established with such piercing engagement may lead to undesired breaking and thus detachment of the power cord and consequently shorting of the lamp string may result. This is certainly not a perfect arrangement and further improvement is needed.

SUMMARY OF THE INVENTION

To overcome the drawback of the conventional way of connecting an illuminant received and retained in a socket of a lamp string with a power cord, the present invention replaces the connection engagement realized with knife-like sharp pins piercing through the power cord by secured direct contact engagement established between terminals of an LED and the conductive cores of a partially stripped power cord for the purposes of eliminating the potential risk of power cord breaking.

To achieve the above object, the present invention provides a connection seat of bulb socket of decorative lamp string, which comprises a main body comprising an upper portion and a bottom portion both having a hollow interior. The top portion comprises a centrally located the partition board on which an LED is seated with two terminals of the LED on opposite sides of the partition board. A cover is mounted to the top portion. The bottom portion comprises a centrally located partition board and two stop boards on two sides and having inside inclination surfaces. The terminals of the LED are arranged to extend into the bottom portion and positioned against the partition board of the bottom portion. The power cord comprises two partially stripped core conductors that are respectively received between the partition board and the stop boards of the bottom portion and are respectively set in engagement with the two terminals of the LED. A bottom cap comprises two raised bars and is mounted to the bottom portion in such a way that the two raised bars push the two core conductors in such a direction to have the core conductors and the terminals of the LED securely fixed between the partition board and the stop boards of the bottom portion. In this way, the power cord can be set in connection with the illuminant without applying the conventionally used piercing engagement, whereby the potential risk of breaking the power cord due to piercing can be eliminated.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
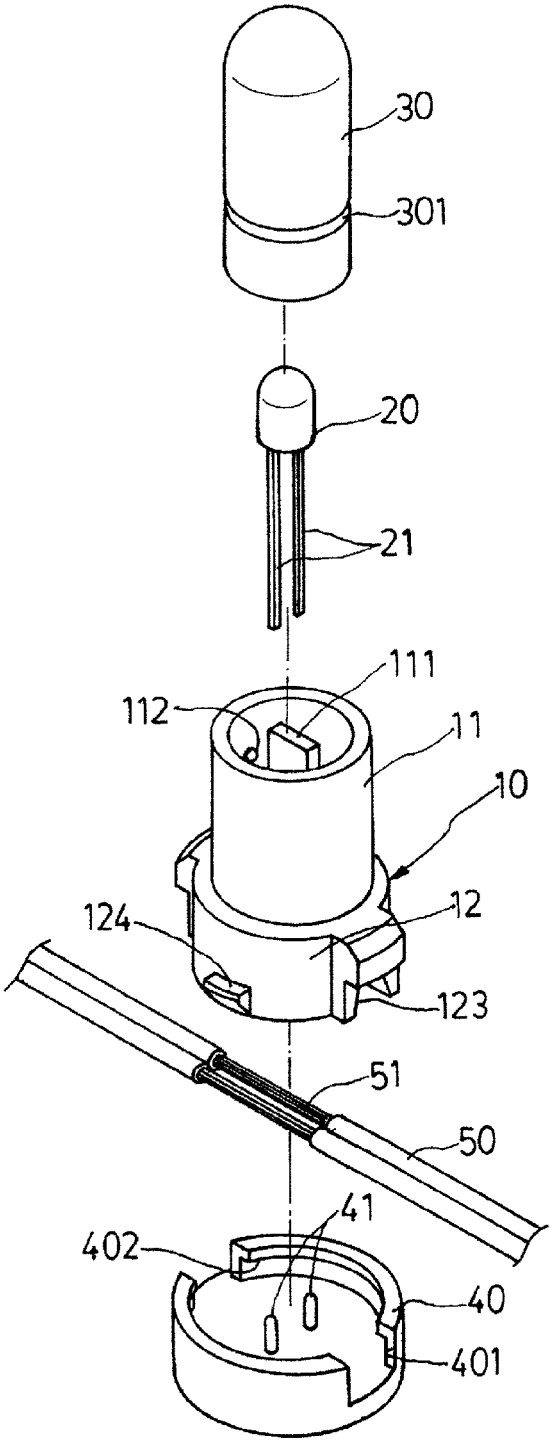
FIG. 1 is an exploded view of the structure of the present invention.
Figure 2:
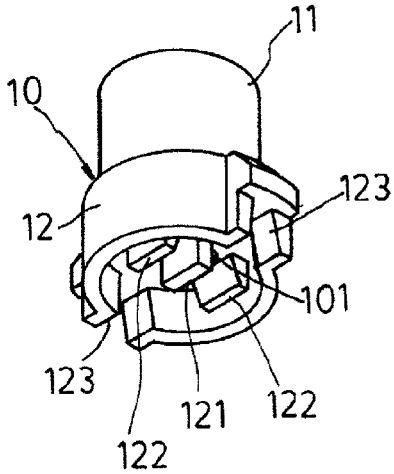
FIG. 2 is a bottom-side perspective view of a main body of the present invention.
Figure 3:
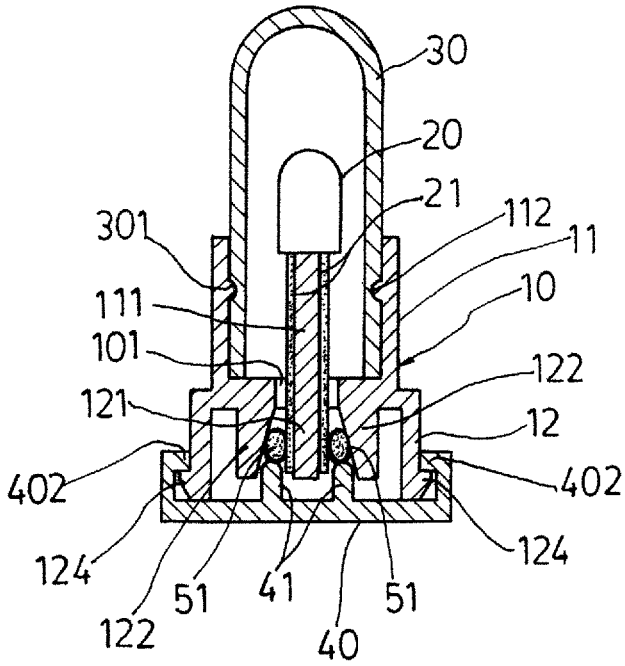
FIG. 3 is a cross-sectional view, in an assembled form, of the present invention.
Figure 4:
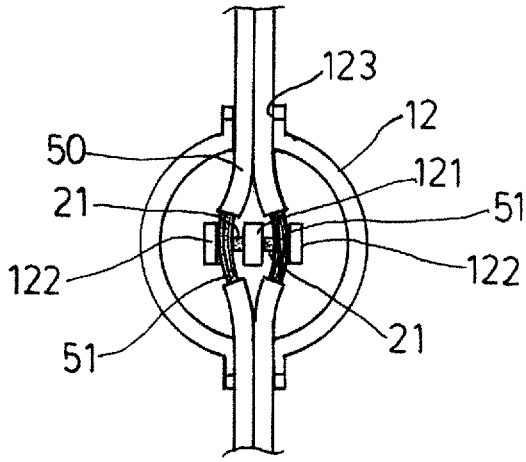
FIG. 4 is a top plan view of the present invention showing a power cord connected to a bottom portion of the main body.

Referring to FIGS. 1-4, the present invention provides a connection seat of bulb socket of decorative lamp string, which is composed of a main body (10), a light-emitting diode (LED) (20), a cover (30), a bottom cap (40), and a power cord (50). The main body (10) comprises a top portion (11) and a bottom portion (12), each defining a hollow interior. The top portion (11) receives a partition board (111) arranged centrally in the interior thereof and mounted to an internal wall between the top portion (11) and the bottom portion (12). The top portion (11) has an inner surface on which retention projections (112) are formed. The bottom portion (12) receives a partition board (121) arranged centrally in the interior thereof and two stop boards (122) located on opposite sides of the partition board (121) and each having a cross-sectional configuration that is wedge like and is wide in top and narrow in bottom so as to define an inside inclination surface facing inwardly. A through hole (101) is formed in the internal wall the partition board (121) and each of the stop board (122) and in communication with the top portion (11) and the bottom portion (12). The bottom portion (12) has a circumferential wall having a lower edge in which opposites cord openings (123) are formed. The circumferential wall of the bottom portion (12) has an outer surface on which two opposite locking lugs (124) are formed at locations angularly shifted from the cord openings. The LED (20) is seated on the partition board (111) of the top portion (11) with two terminals (21) located on opposite sides of the partition board. The cover (30) is partially fit into the top portion (11) to cover and house the LED (20) and has an outer circumferential surface in which an engagement recess (301) is formed for providing a retaining engagement with the retention projections (112) formed on the inner surface of the top portion (11). The bottom cap (40) has a bottom wall on which two spaced raised bars (41) are formed to respectively correspond to the spaces between the partition board (121) and the stop boards (122) of the bottom portion (12). The bottom cap (40) has a circumferential wall having a top in which cord openings (401) are formed to correspond to the cord openings (123) of the bottom portion (12). Engagement flanges (402) are formed on an inner surface of the top end of the circumferential wall of the bottom cap (40). The power cord (50) comprises two insulation-covered conductor wires of which the insulation jackets are partially stripped to expose a portion of each of the core conductors (51), as shown in FIG. 4. The power cord (50) so partially stripped is placed in the cord openings (123) of the bottom portion (12) in such a way that the two core conductors (51) are respectively received between the partition board (121) and the stop boards (122) to get in contact engagement with the two terminals (21) of the LED (20). The bottom cap (40) is then mounted to the bottom portion (12) by having the locking lugs (124) of the bottom portion (12) engaging the engagement flanges (402) of the bottom cap (40). Consequently, the two raised bars (41) of the bottom cap (40) push the core conductors (51) of the power cord upward and the inside inclination surfaces of the stop board (122) force the core conductors (51) of the power cord into secured tight engagement with the two terminals (21) of the LED (20).

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A connection seat of bulb socket of decorative lamp string, comprising a main body comprising an upper portion and a bottom portion both having a hollow interior, the top portion comprising a centrally located the partition board on which an LED is seated with two terminals of the LED on opposite sides of the partition board, a cover being mounted to the top portion to cover the LED, the bottom portion comprising a centrally located partition board and two stop boards on two sides and having inside inclination surfaces, the terminals of the LED being arranged to extend into the bottom portion and positioned against the partition board of the bottom portion, the power cord comprising two partially stripped core conductors that are respectively received between the partition board and the stop boards of the bottom portion and are respectively set in engagement with the two terminals of the LED, a bottom cap comprising two raised bars and being mounted to the bottom portion in such a way that the two raised bars push the two core conductors in such a direction to have the core conductors and the terminals of the LED securely fixed between the partition board and the stop boards of the bottom portion.

2. The connection seat of bulb socket of decorative lamp string according to claim 1, wherein each of the stop boards of the bottom portion is of a cross-sectional configuration that is wedge like and is wide in top and narrow in bottom to define the inside inclination surface, the partition board and the stop boards of the bottom portion being mounted to an internal wall in which a through hole is formed and located between each of the stop boards and the partition board to communicate between the top portion and the bottom portion.

3. The connection seat of bulb socket of decorative lamp string according to claim 1, wherein the bottom portion has a circumferential wall in which opposite cord openings are formed, the circumferential wall having an outer surface on which opposite locking lugs are formed and angularly separated from the cord openings.

4. The connection seat of bulb socket of decorative lamp string according to claim 1, wherein the bottom cap has a circumferential wall having a top in which cord openings are formed to correspond to the cord openings of the bottom portion, the engagement flanges being formed on an inner surface of an top end of the circumferential wall.

* * * * *